US007503388B2

(12) United States Patent
Fay et al.

(10) Patent No.: US 7,503,388 B2
(45) Date of Patent: Mar. 17, 2009

(54) CIRCUMFERENTIALLY LOADED SLIP-TYPE OVERSHOT RETRIEVAL TOOL

(75) Inventors: Peter J. Fay, Houston, TX (US); Gerald D. Lynde, Houston, TX (US); Douglas J. Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 104 days.

(21) Appl. No.: 11/586,372

(22) Filed: Oct. 26, 2006

(65) Prior Publication Data

US 2008/0099205 A1 May 1, 2008

(51) Int. Cl.
*E21B 33/12* (2006.01)

(52) U.S. Cl. ..... 166/301; 166/98; 294/86.27; 294/86.31

(58) Field of Classification Search ..... 166/301, 166/98; 294/86.26, 86.27, 86.3, 86.31
See application file for complete search history.

(56) References Cited

U.S. PATENT DOCUMENTS

| | | | | |
|---|---|---|---|---|
| 1,527,413 | A | 2/1925 | Hinderliter | |
| 1,707,072 | A * | 3/1929 | Black | 166/72 |
| 1,745,274 | A | 1/1930 | Sauls | |
| 1,754,696 | A | 4/1930 | Sauls | |
| 1,763,703 | A | 6/1930 | Hinderliter | |
| 1,773,692 | A | 8/1930 | Davis | |
| 1,776,027 | A | 9/1930 | Hinderliter | |
| 1,791,529 | A * | 2/1931 | Lamoureux et al. | 294/86.17 |
| 1,797,505 | A | 3/1931 | Jones et al. | |
| 1,825,025 | A | 9/1931 | Thomas et al. | |
| 2,128,430 | A * | 8/1938 | Pryor | 294/86.21 |
| 2,272,529 | A | 1/1942 | Larson et al. | |
| 2,665,164 | A | 1/1954 | Spang | |
| 3,380,528 | A | 4/1968 | Timmons | |
| 4,548,437 | A | 10/1985 | Driskill | |
| 4,801,167 | A | 1/1989 | Driskill | |
| 5,054,833 | A * | 10/1991 | Bishop et al. | 294/86.3 |
| 6,315,047 | B1 | 11/2001 | Deaton et al. | |
| 2006/0278404 | A1 | 12/2006 | Fay | |

OTHER PUBLICATIONS

Bowen Tools, Inc., Instruction Manual Bowen Series 150 Releasing and Circulating Overshot, May 1992, Twenty-Third Publishing, USA.

* cited by examiner

*Primary Examiner*—William P Neuder
(74) *Attorney, Agent, or Firm*—Greenberg Traurig LLP; Anthony F. Matheny

(57) ABSTRACT

Overshot fishing tools for retrieving objects, i.e., "fish" lodged within a wellbore are disclosed. The overshot fishing tool comprises a housing having a housing bore with at least one recess disposed along the inner wall surface of the housing bore. A slip is disposed within each of the recesses. Each slip has a gripping profile for engaging and securing the fish. Each slip also has a length and a width such that the slip, when actuated, provides circumferential loading on the housing. In specific embodiments, each slip includes two or more different gripping profiles to facilitate retrieval of different types and sizes of fish.

20 Claims, 9 Drawing Sheets

CIRCUMFERENTIALLY LOADED SLIP-TYPE OVERSHOT RETRIEVAL TOOL

BACKGROUND

1. Field of Invention

The invention is directed to tools for retrieving an object disposed in the bore of a well, and in particular, to overshot fishing tools.

2. Description of Art

It is common for objects such as tools and broken segments of pipe to become forcibly lodged within the wellbore of an oil or gas well. In order for these objects to be removed from the wellbore, various fishing tools have been developed for the purpose of latching onto and retrieving the object, referred to in the industry as the "fish," from the wellbore. One type of fishing tool functions by gripping onto the outer surface, e.g., the outer diameter of a segment of pipe, of the fish. These types of fishing tools are referred to as "overshot" fishing tools. Other types of fishing tools that function by gripping the lumen of the fish, e.g., the inner diameter of a segment of pipe of the fish.

Regardless of type of fishing tool, after the fish is gripped by the fishing tool, the fishing tool and the fish are transported to the surface of the well. These prior fishing tools, however, are cumbersome to operate and are not designed to grab and retrieve different types of fish. For example, some fishing tools are only able to grab and retrieve fish that are pipe segments. Other fishing tools are only able to grab and retrieve objects having an outer diameter that falls within a narrow range. For example, most known overshot fishing tools cannot retrieve fish having a variation in size of more than 1/16th of an inch. In other words, if a fish is believed to have an outer diameter of 2 inches, a corresponding overshot fishing tool is capable of grabbing the fish if the actual outer diameter is within the range of 2 1/16 inches and 1 15/16 inches. A fish having a larger or smaller outer diameter cannot be grabbed by the prior art fishing tool.

Additionally, prior art overshot fishing tools provide axial and radial loading on the fish and on the housing of the fishing tool, without any circumferentially loading. Such overshot fishing tools that load axially and radially, without circumferentially loading, are limited as to the size and weight of the fish that can be retrieved.

SUMMARY OF INVENTION

The overshot tools disclosed herein attempt to overcome one or more of the foregoing disadvantages of the prior art by providing an overshot fishing tool capable of grabbing and retrieving different types of fish in a quick and easy to operate manner. The overshot fishing tools disclosed herein provide circumferential loading of the overshot tool housing thereby permitting the retrieval of larger and different sizes of fish. Additionally, an overshot fishing tool disclosed herein is capable of retrieving fish having outer diameters that fall within a range that is greater than plus or minus 1/16th of an inch. In other words, an overshot fishing tool of the invention designed to grab a fish having an outer diameter of 2 inches would be able to grab the fish even if the actual outer diameter is smaller than 1 15/16 inches or larger than 2 1/16 inches. Thus, a single overshot fishing tool and, thus, a single run into the well, can grab a larger range of fish.

Broadly, the overshot fishing tools of the invention include a housing having a passageway there-through. The housing has an outer diameter and an inner diameter defining a passageway or housing bore. The housing bore is preferably divided into at least two portions, an upper portion and a lower portion, either of which, none of which, or both of which may be concentric with the axis of the housing defined by the outer diameter of the housing.

Disposed along the inner diameter is one or more recesses having a slip disposed therein. Each slip includes an upper end, a lower end, a gripping wall surface and an outer surface. The slips are designed to have a length that preferably transverses the upper and lower portions of the housing bore. As a result, a single slip is capable of gripping and retrieving certain fish within a well by positioning the housing over the fish such that the fish enters the housing bore. Rotational or axial movement of the housing or the slip results in the gripping wall surface of the slip engaging and securing the fish within the housing bore.

In one specific embodiment, the gripping wall surface has two or more gripping profiles, one or more of which is different from one or more of the other gripping profiles to facilitate securing different types and sizes of fish. For example, the lower portion of the gripping wall surface may include a first profile that is capable of gripping one type of fish, e.g., a downhole tool. A second portion of the gripping wall surface may include a second profile that is capable of gripping another type of fish, e.g., a segment of pipe having an outer diameter falling into a first range of outer diameters. A third portion of the gripping wall surface may include a third profile that is capable of gripping still another type of fish, e.g., a segment of pipe having an outer diameter falling into a second range of outer diameters, the outer diameters within this second range of outer diameters being smaller than the outer diameters within the first range of outer diameters.

The overshot tools disclosed herein attempt to overcome one or more of the foregoing disadvantages of the prior art by providing an overshot fishing tool capable of grabbing and retrieving different types and a larger range of diameters of fish in a quick and easy to operate manner.

In one aspect, one or more of the forgoing advantages have been achieved by the present overshot tool for retrieving an object in a well. The tool comprises a housing having an upper end for attaching to a string for lowering the tool into a well, a housing bore defined by an inner wall surface, the inner wall surface having a recess disposed therein; and a slip carried within the recess, the slip having an upper slip end, a length, a width, and a gripping wall surface facing toward the housing bore, the gripping wall surface having a gripping profile to engage and facilitate securing an object within the housing bore, the width being narrower than the length, and the slip being movable relative to the recess from an unset position to a set position wherein the gripping wall surface protrudes into the bore, a lower portion of the housing being open at a lower end of the housing for sliding over the object in the well while the slip is held in the recess, so that subsequent actuation of the slip toward the set position causes the gripping profile of the gripping wall surface to engage and secure the object for retrieval, and the slip and the recess having mating surfaces that provide a circumferential force component in the set position.

A further feature of the overshot tool is that the gripping wall surface of the slip may be substantially flush with the inner wall surface of the bore while in the unset position. Another feature of the overshot tool is that the slip may be actuatable by axial movement of the slip relative to a longitudinal axis of the housing. An additional feature of the overshot tool is that the gripping wall surface may comprise at least two different ones of the gripping profiles. Still another feature of the overshot tool is that the housing bore may have an upper portion with a diameter smaller than a lower portion of the bore, and the recess and the slip may each comprise a length that transverses the upper portion and the lower portion of the housing bore. A further feature of the overshot tool is that the housing may have a sidewall with a thicker portion and a thinner portion opposite the thicker portion, and the recess and the slip may be located in the thicker portion opposite from a smooth portion of the housing bore. Another feature of the overshot tool is that the recess and the slip may have widths that taper along their lengths. An additional feature of the overshot tool is that the recess may have a base, loading surfaces, and a width between the loading surfaces, the loading surfaces being located in planes that diverge in an inward direction and the width of the recess between the loading surfaces gradually decreases along the length of the recess; the slip may have loading surfaces and a width between the loading surfaces, the loading surfaces being at the same angles and mate with the loading surfaces of the recess; and the width of the slip may decrease along its length the same as the recess, so that moving the slip along the length of the recess in one direction causes the gripping surface of the slip to protrude from the recess. Still another feature of the overshot tool is that the upper slip end may comprise an attachment member to facilitate actuation of the slip by axial movement of the slip relative to the housing. A further feature of the overshot tool is that the housing may comprise a plurality of the recesses, each carrying one of the slips therein. Another feature of the overshot tool is that the slip may have a multi-tier arrowhead shape of varying width along its length. An additional feature of the overshot tool is that the gripping profile may comprise a plurality of wickers.

In another aspect, one or more of the foregoing advantages may be achieved through the present an overshot tool comprising a housing having a string connection end, an open end, and a housing bore with an axis disposed longitudinally through the housing and in fluid communication with the open end; at least one elongated recess in the bore, the recess having a base and two loading surfaces that diverge relative to each other, the recess having a width between the loading surfaces that decreases in an axial direction; a slip disposed within each of the at least one recesses, the slip having a length and loading surfaces that mate with the loading surfaces of the recess, the slip having a width between its loading surfaces that decreases in the same manner as the recess, and the slip having a gripping wall surface facing toward the housing bore; and an actuator for moving the slip axially relative to the recess, which causes the gripping wall surface to move inward into the bore to grip an object in the well.

A further feature of the overshot tool is that the loading surfaces of the recess may be located in planes that have a positive included angle between them. Another feature of the overshot tool is that the tool may further comprise an undercut portion along part of each of the loading surfaces of the recess, defining a slip retaining shoulder; and a shoulder on each loading surfaces of the slip that fits within the undercut portion behind the slip retaining shoulder. An additional feature of the overshot tool is that the slip and the recess may each comprise a multi-tier arrowhead shape, each tier of the multi-tier arrowhead shape having a width that decreases from a maximum to a minimum.

In another aspect, one or more of the foregoing advantages have been achieved through the present method of retrieving a fish disposed in a bore of a well. The method comprising the steps of: (a) running an overshot tool into a well, the overshot tool comprising a housing having a longitudinal housing bore defined by an inner wall surface, the inner wall surface having a recess disposed therein and a slip carried within the recess, the slip having a length, a width, and a gripping wall surface facing toward the housing bore, the width being narrower than the length; (b) lowering the housing bore over the fish while the slip is held within the recess; (c) moving the slip longitudinally relative to the recess to protrude into the bore and engage the gripping wall surface with the fish through a circumferential force component to secure the fish within the housing bore; then (d) removing the overshot tool and the fish from the bore of the well.

A further feature of the method of retrieving a fish disposed in a bore of a well is that step (c) may be performed by applying fluid pressure to a piston. Another feature of the method of retrieving a fish disposed in a bore of a well is that the slip and the recess may be located opposite a smooth portion of the inner wall surface of the housing bore. An additional feature of the method of retrieving a fish disposed in a bore of a well is that step (a) may be performed by lowering the tool on a string of conduit; and step (c) may be performed by pumping fluid down the conduit to a piston located in the housing bore.

The overshot tools disclosed herein provide an overshot fishing tool capable of grabbing and retrieving different types of fish in a quick and easy to operate manner.

While the invention will be described in connection with the preferred embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

Figure 1:
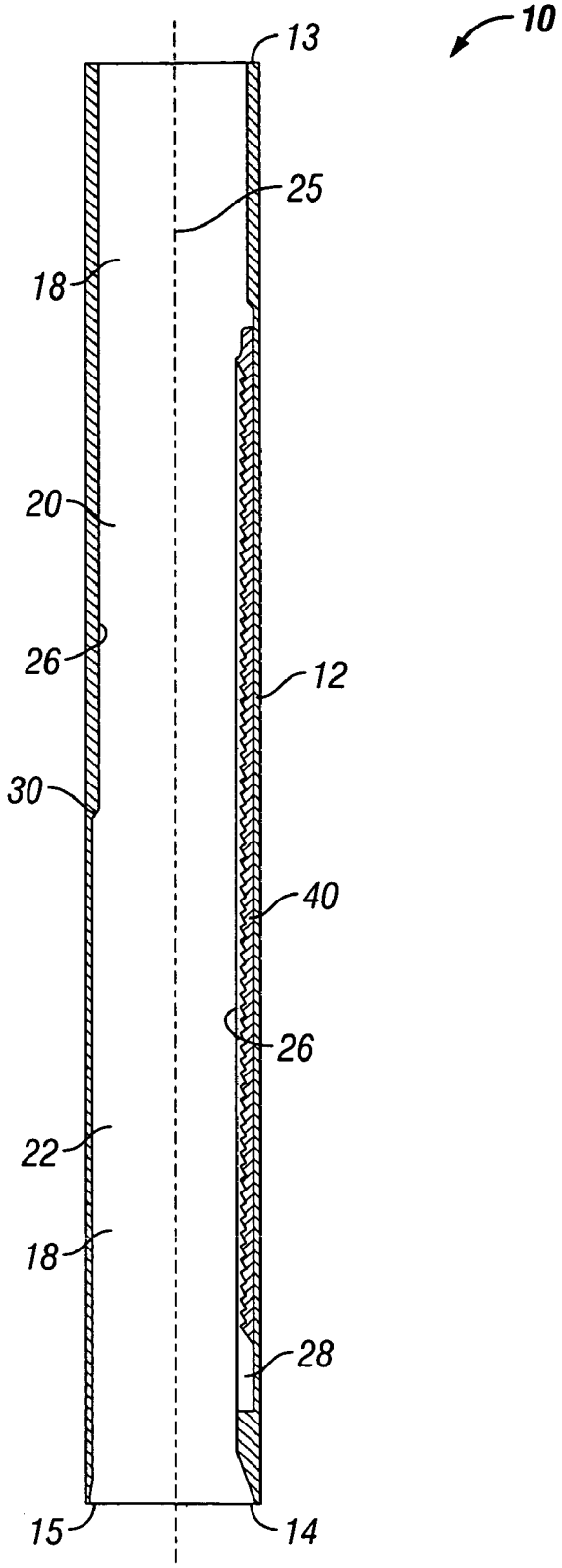
FIG. 1 is a cross-sectional view of one specific embodiment of the overshot tool disclosed herein shown in the unset position.

Referring to FIG. 1, overshot tool 10 is shown in its unset position, i.e., the position at which overshot tool 10 is run or lowered into a well prior to securing the fish 200. Overshot tool 10 includes cylindrical housing 12 having upper end 13 having threads (not shown) or other structure to facilitate attaching upper end 13 to a string of conduit, such as drill pipe or coiled tubing, for lowering or running overshot tool 10 into a well, for raising or removing overshot tool 10 from the well, and, in one particular embodiment, for rotating housing 12. Housing 12 is a tubular member, preferably having a cylindrical outer diameter.

Overshot tool 10 also includes lower end 14 having opening 15 of housing bore 18 defined by an inner wall surface 26. Housing bore 18 has upper portion 20 and lower portion 22. Both upper portion 20 and lower portion 22 are cylindrical but offset or eccentric relative to the cylindrical outer diameter of housing 12. The outer diameter of housing 12 has a center line or axis 25. Downward facing shoulder 30 delineates housing bore upper portion 20 from housing bore lower portion 22.

Preferably, opening 15 is conical or flared. Because lower portion 22 is offset, the flared portion of opening 15 has a height that varies from a minimum on one point, shown on the left side of FIG. 1, to a maximum 180 degrees away from the minimum point. Flared opening 15 facilitates entry of a fish 200 (FIGS. 5 and 7-9) into housing bore 18, which is in fluid communication with opening 15. Similarly, because of the offset of upper portion 20 and lower portion 22 relative to the outer diameter of housing 12, the housing wall thickness at lower end 14 varies from a minimum at one point to a maximum 180 degrees away.

Upper portion 20 and lower portion 22 are preferably eccentric with the outer diameter of housing 12 and housing axis 25. Thus, neither upper portion 20 nor lower portion 22 has an axis that coincides with housing axis 25. In other words, both upper portion 20 and lower portion 22 have axes that are offset from and parallel to housing axis 25. Although overshot tool 10 is shown as having both upper portion 20 and lower portion 22 eccentric relative to housing axis 25, it is to be understood that one or both of upper portion 20 and lower portion 22 may be concentric relative to housing axis 25. Additionally, only one of upper portion 20 or lower portion 22 may be concentric with housing axis 25. Further, upper portion 20 and lower portion 22 may share a common axis or upper portion 20 may have an axis different from the axis of lower portion 22.

Preferably, upper portion 20 has an inner diameter that is less than the inner diameter of lower portion 22. In this arrangement, larger fish are secured within housing bore 18 in lower portion 22 and smaller fish are secured within housing bore 18 in upper portion 20. Thus, smaller fish are disposed further within housing bore 18 of overshot tool 10 to reach a smaller inner diameter portion of housing bore 18.

Figure 6:
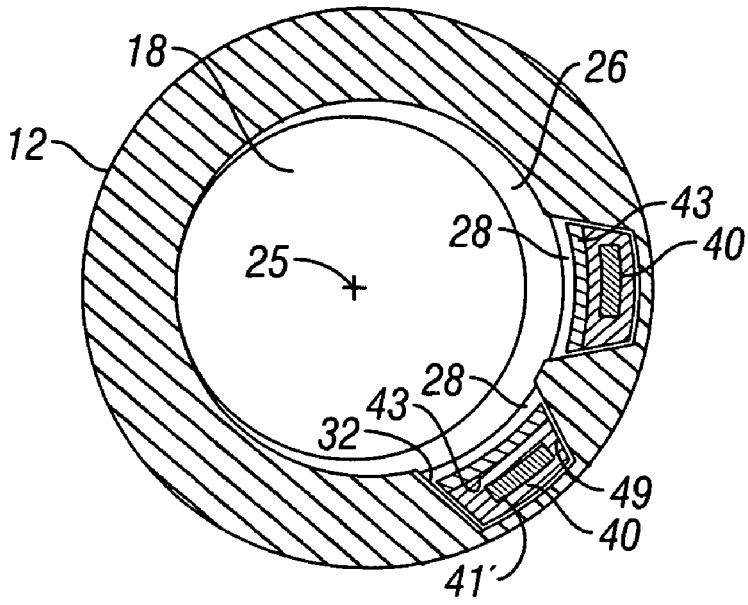
FIG. 6 is a cross-sectional view of the overshot tool of FIG. 5 taken along line 6-6.
Figure 7:
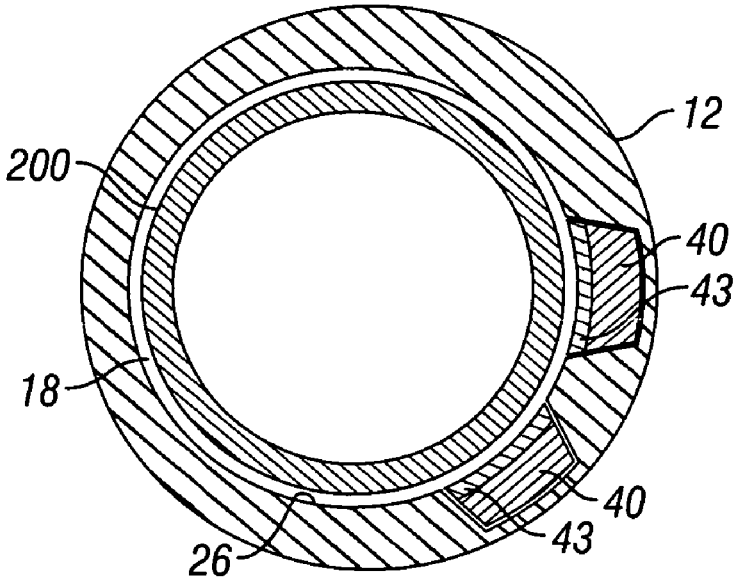
FIG. 7 is a cross-sectional view of the overshot tool of FIG. 5 taken along line 7-7.
Figure 8:
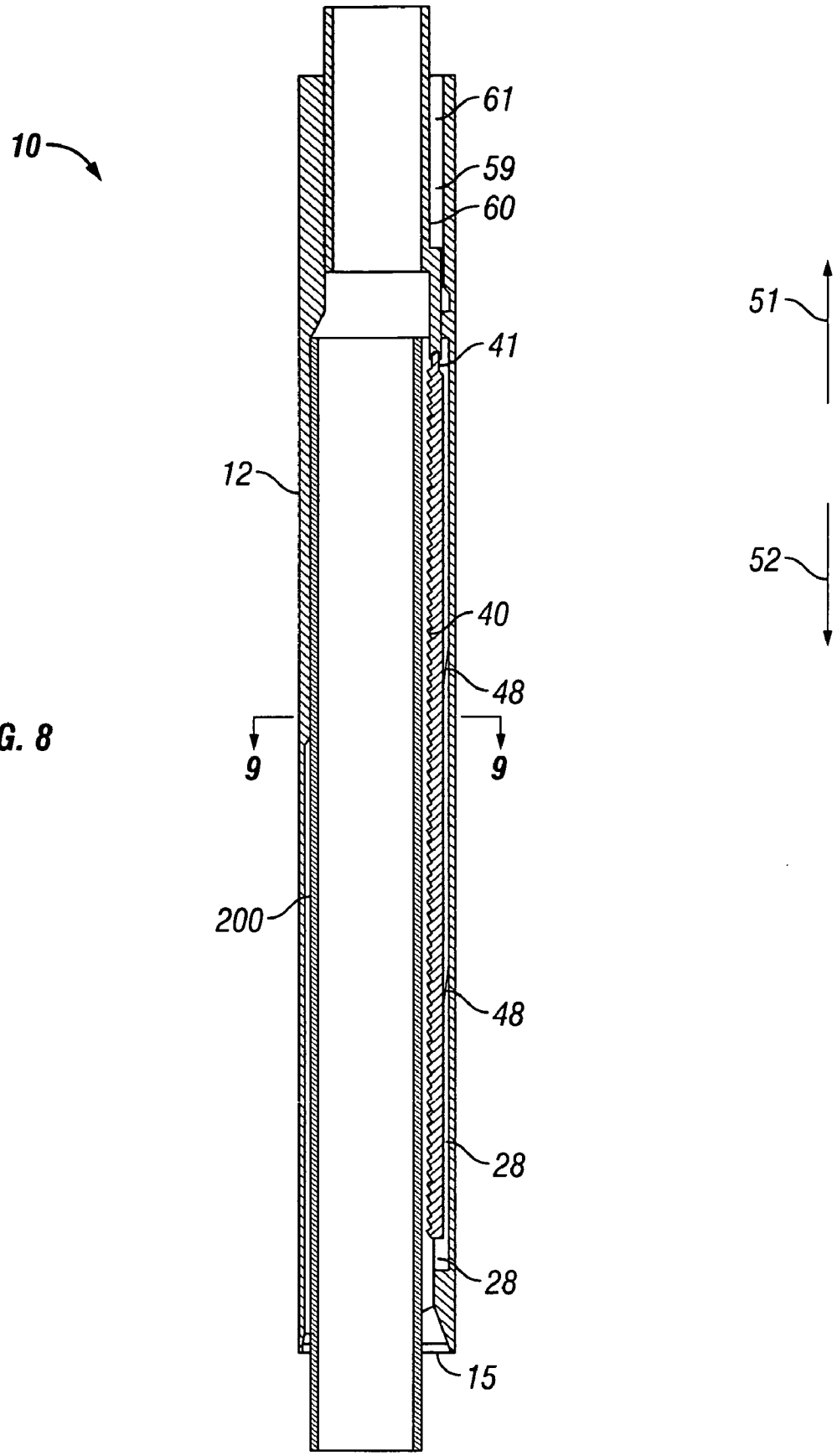
FIG. 8 is a cross-sectional view of the overshot tool of FIG. 1 illustrating a fish being gripped by the overshot tool, i.e., the set position.
Figure 9:
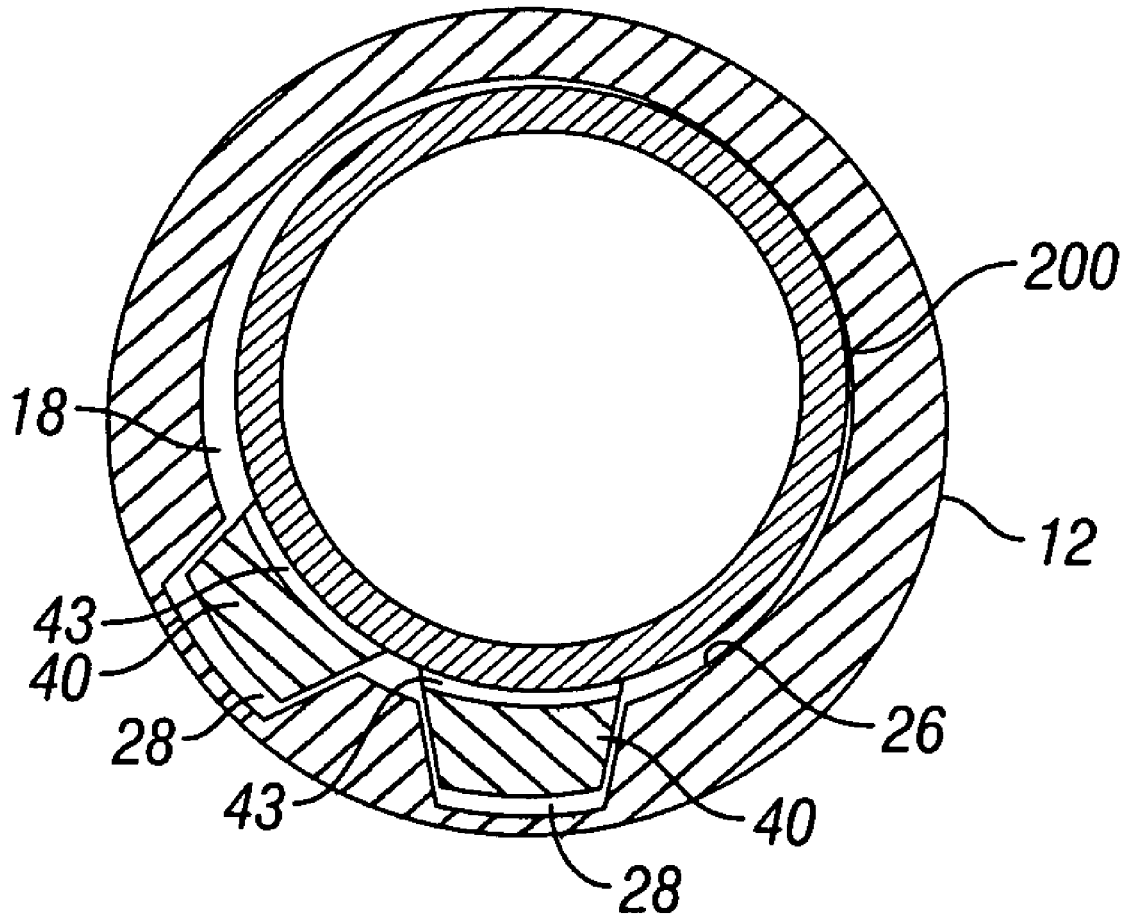
FIG. 9 is a cross-sectional view of the overshot tool of FIG. 8 taken along line 9-9.

Inner wall surface 26 defines housing bore 18 and includes one or more elongated, axially extending pockets or recesses 28. Recesses 28 are spaced circumferentially apart from each other and located in the thicker portion of the sidewall of housing 12, as shown in FIGS. 6 and 7. In one embodiment, bore 18 is smooth on the side opposite recesses 28. Each recess 28 has a shape that is substantially reciprocal to slip 40 (described in greater detail below) so that slip 40 is held within recess 28 when overshot tool 10 is in its unset position (FIGS. 1 and 5) and so that slip 40 will be held fast when overshot tool 10 is placed in its set position (FIG. 8). In an alternative embodiment, bore 18 has wickers (not shown) adapted to facilitate gripping of fish 200. As shown in FIGS. 1 and 3-5, each recess 28 includes a length that preferably is more than half the length of housing 12 and, more preferably, extends into both bore upper portion 20 and bore lower portion 22. Recess 28 also includes a width that is much smaller than its length and which may vary along its length as shown in FIG. 4 and described below. As shown in FIGS. 4A-4C, each recess 28 has a base 29 that is partially cylindrical. Preferably the depth of each recess 28 from base 29 to housing bore surface 26 is constant from its upper end to its lower end. Recess 28 also includes recess holding surfaces 31 (FIG. 4C) and recess loading surfaces 32 which are described in greater detail below in relation to slip 40.

As shown in FIGS. 4A-4C, recess 28 has two recess holding surfaces 31 and two recess loading surfaces. However, it is to be understood that recess 28 may have more than two recess holding surfaces 31 and more than two recess loading surfaces 32. Additionally, in one specific embodiment (not shown), recess 28 may have a single arcuate recess loading surface 32. Recess loading surfaces 32 provide a circumferential force component, or loading, of housing 12 when the fish is grabbed by overshot tool 10.

Figure 2:
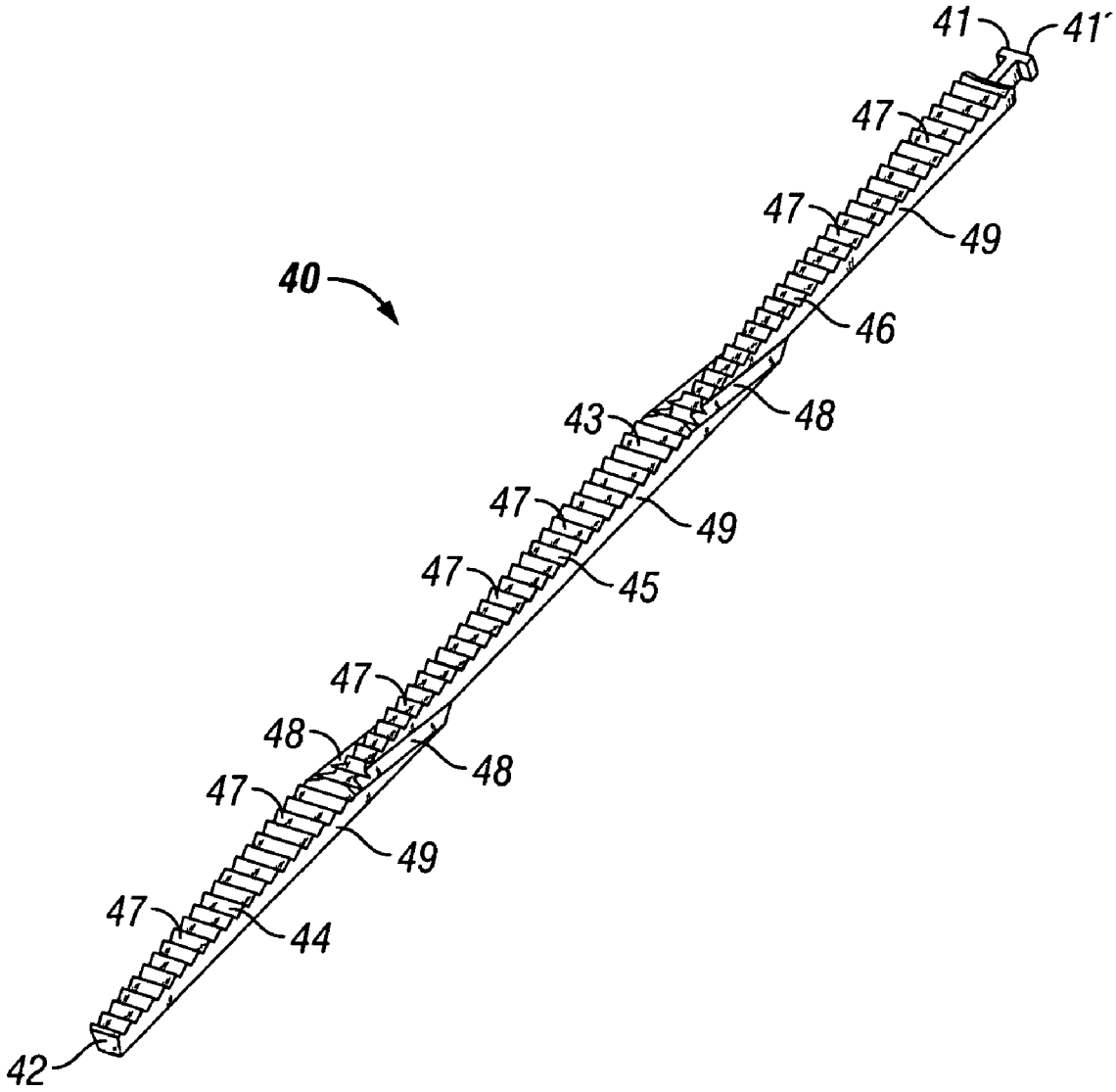
FIG. 2 is a perspective view of one specific slip for use with one specific embodiment of the overshot tool disclosed herein.

Slip 40 is an elongated member with a first end 41, second end 42, gripping wall surface 43, and an outer wall surface 39 spaced next to base 29 (FIGS. 4A-4C) of recess 28. First end 41 may include having any design or shape known to persons of ordinary skill in the art to facilitate connection of slip 40 to housing 12 or to an actuation tool described in greater detail below. As shown in FIG. 2, first end 41 is a T-shaped extension 41' in this embodiment.

Gripping wall surface 43 is preferably profiled with, for example, wickers 47, which are parallel grooves, to facilitate gripping fish 200 (FIGS. 5 and 7-9). Alternatively, gripping wall surface 43 may be profiled with grippers formed of carbide or other material, velcro material, ball bearings, or spray-on grit surfaces, or any other material that facilitates increased friction or provides surface penetration of the fish along gripping wall surface 43. In a preferred embodiment, gripping wall surface 43 is curved or concave, having the same curvature as housing bore 18 to facilitate gripping fish 200. In one specific embodiment, gripping wall surface 43 is a cam surface causing a camming motion against fish 200 to facilitate gripping fish 200.

Slip 40 includes a length that, like recess 28 into which it fits, preferably is more than half the length of housing 12 and, more preferably, extends into both bore upper portion 20 and bore lower portion 22. Slip 40 also includes a width much smaller than its length and which preferably varies along its length, as shown in FIG. 4 and described below. Preferably, slip 40 has a shape and size that is substantially reciprocal to recess 28 so that slip 40 can be held within recess 28 when overshot tool 10 is in its unset position (FIGS. 1 and 5) and so that slip 40 can hold fast when overshot tool 10 is placed in its set position (FIG. 8). In the embodiments shown, slip 40 is axially movable relative to recess 28 from the unset to the set position. When in the unset position, gripping wall surface 43 is substantially flush with bore inner wall 26. When in the set position, gripping wall surface 43 protrudes inward past inner wall 26 into bore 18, as can be seen in FIGS. 4A-4C and 9.

Figure 5:
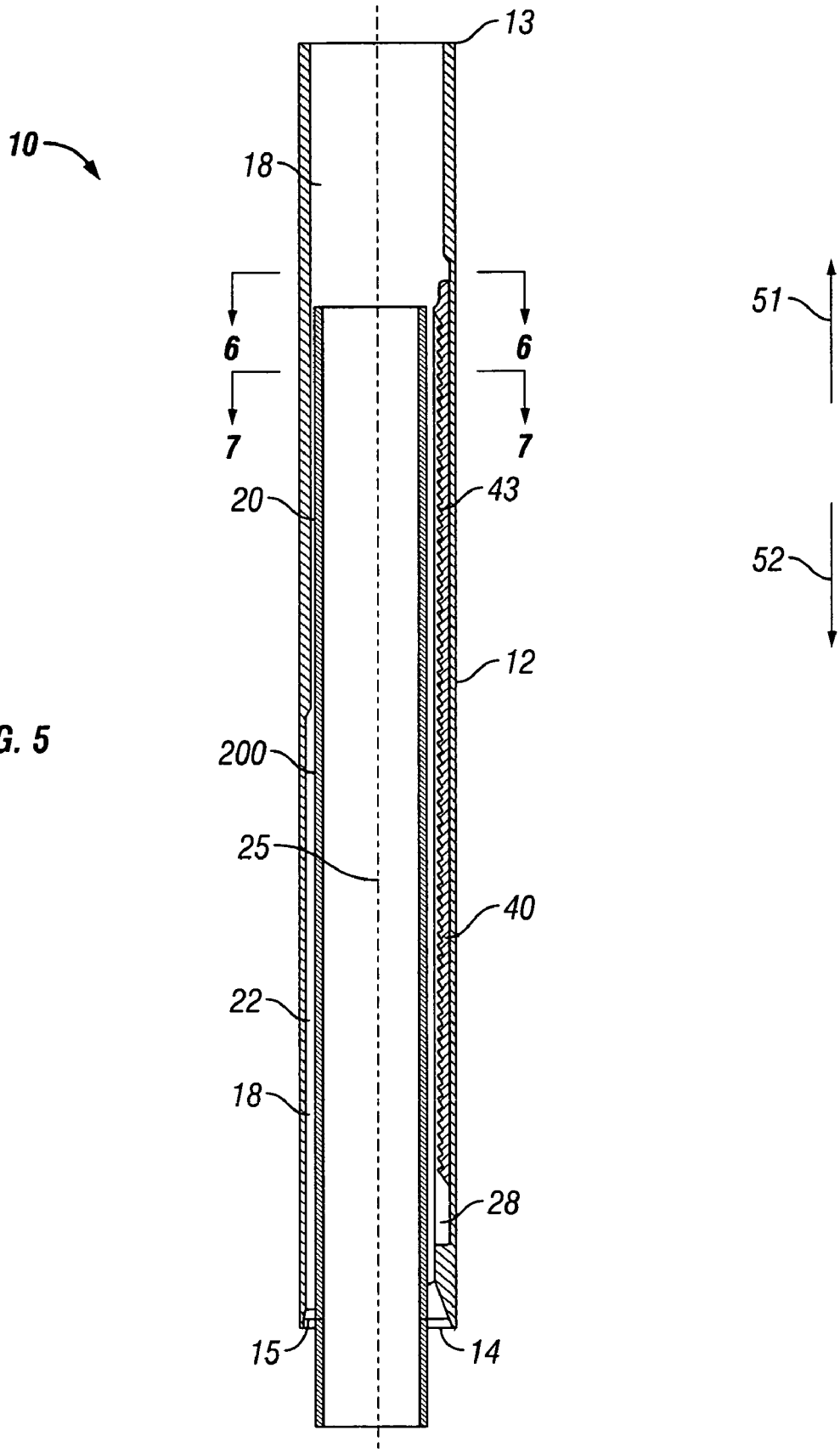
FIG. 5 is cross-sectional view of the overshot tool shown in FIG. 1 illustrating a fish disposed within the overshot tool prior to the fish being gripped by the overshot tool, i.e., the unset position.

As shown best in FIGS. 1, 5 and 8, the thickness of slip 40 is not constant. The thickness near first end 41 of slip 40 is greater than the thickness of slip 40 near second end 42. The change in thickness further facilitates gripping of different sized fish. It is to be understood, however, that although slip 40 is shown as having a varying thickness along its length, the thickness of slip 40 can be constant along the entire length of slip 40.

Figure 3:
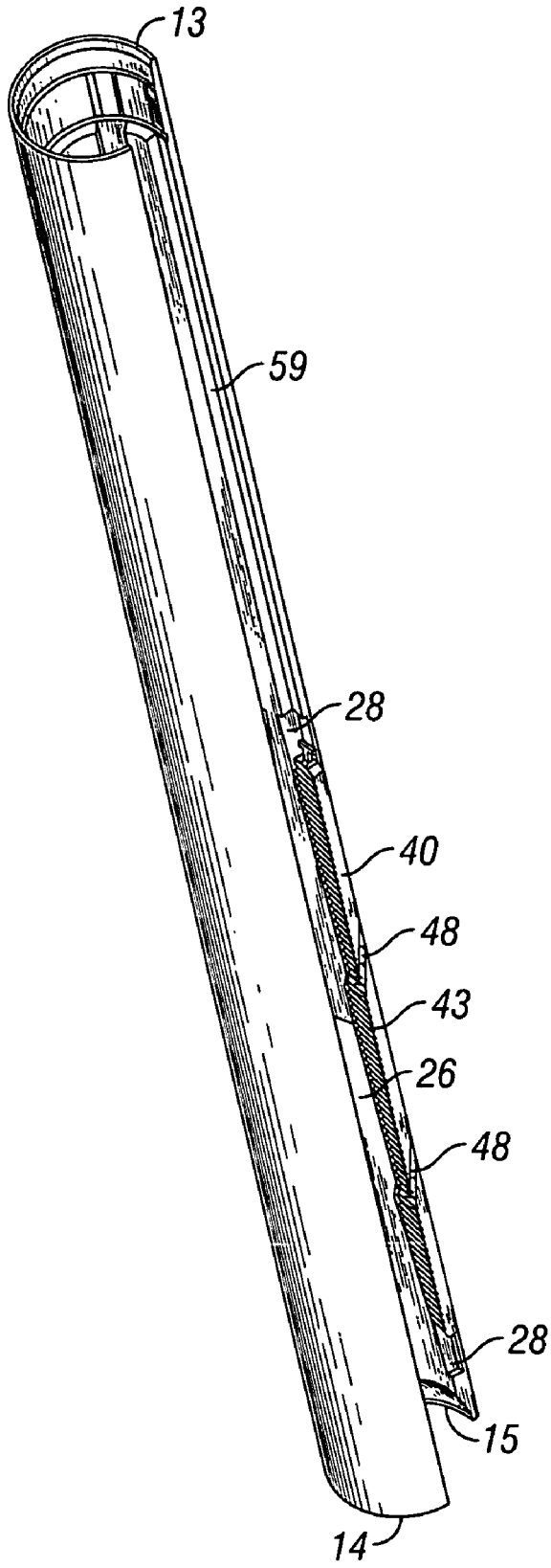
FIG. 3 is a partial cut-away view of the overshot tool shown in FIG. 1 shown in the unset position.
Figure 4:
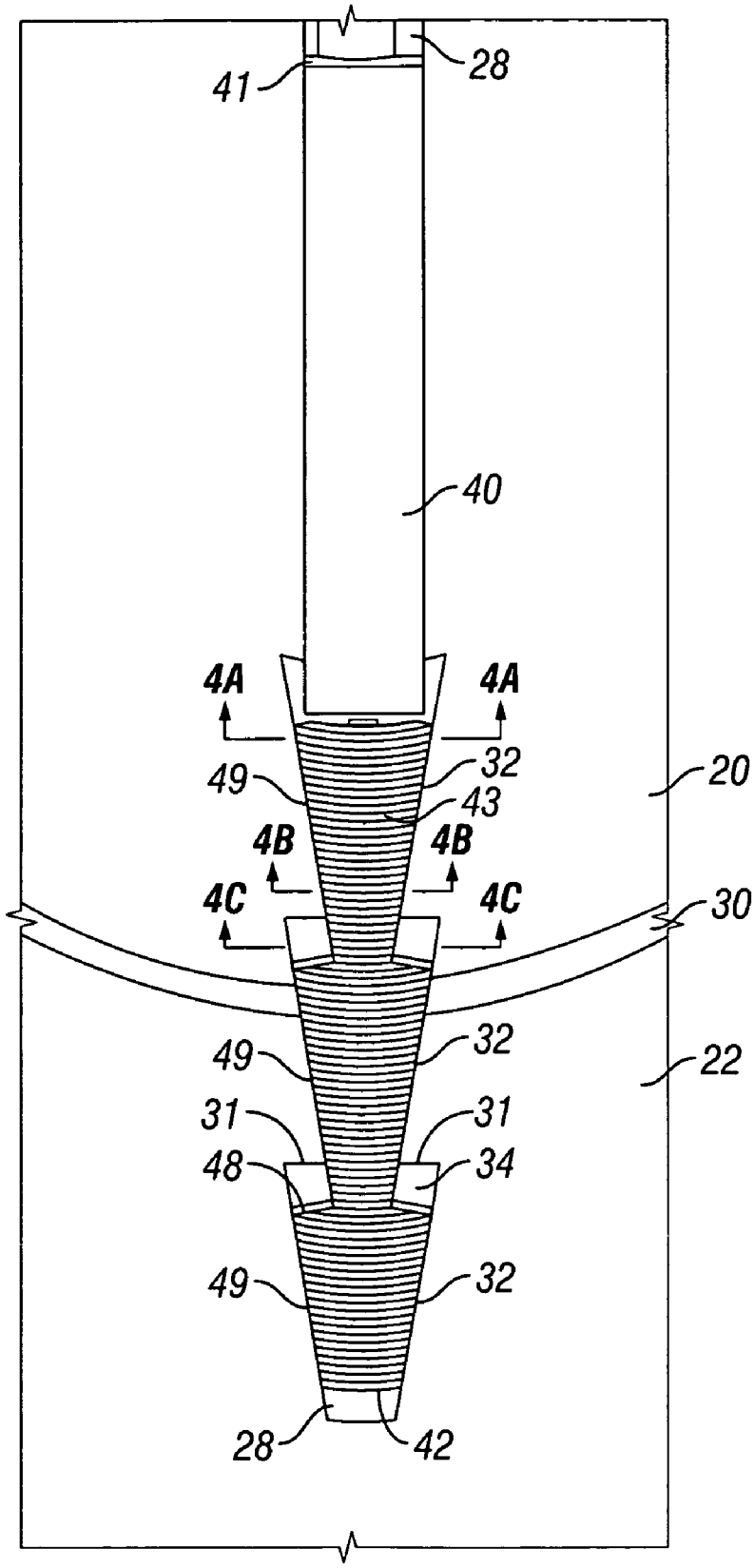
FIG. 4 is an enlarged perspective view of one specific slip disposed within a recess of one specific embodiment of the overshot tool disclosed herein shown in the set position.
Figure 4A:
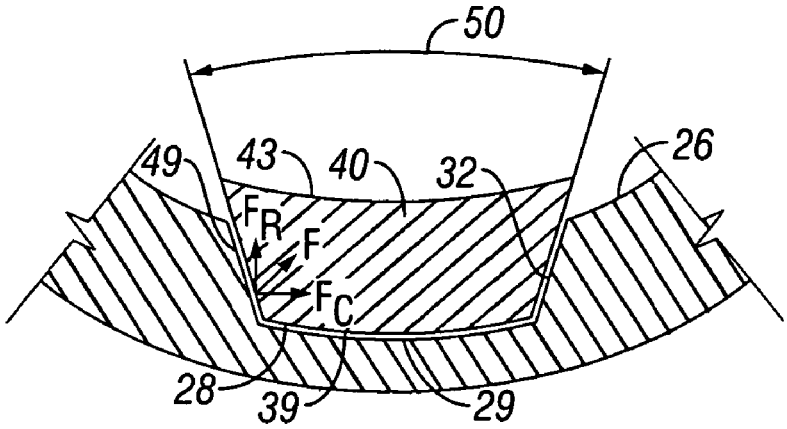
FIG. 4A is an enlarged partial sectional view of the slip shown in FIG. 4 and taken along the line 4A-4A.
Figure 4B:
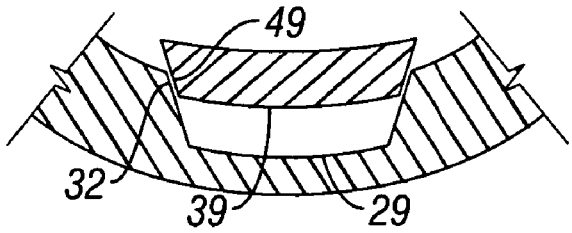
FIG. 4B is an enlarged partial sectional view of the slip shown in FIG. 4 and taken along the line 4B-4B.
Figure 4C:
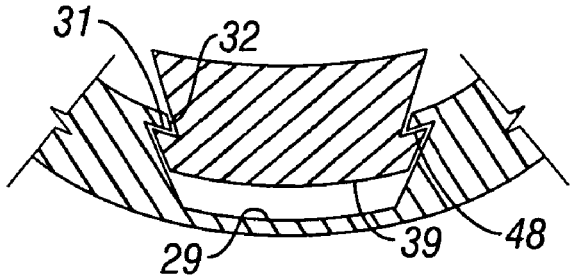
FIG. 4C is an enlarged partial sectional view of the slip shown in FIG. 4 and taken along the line 4C-4C.

As illustrated in FIGS. 2-4, slip 40 includes slip holding surfaces 48 to facilitate slip 40 being held in recess 28 during run in of overshot tool 10, i.e., when overshot tool 10 is in its unset position (FIGS. 1 and 5). As shown best in FIGS. 3 and 4C, holding surfaces 48 are located on opposite side edges of gripping surface 43 and comprise tapered shoulders extending from gripping surface 43 to slip outer surface 39. Recess holding surfaces 31 are outward facing shoulders formed by undercut portions within recess 28. Recess holding surfaces 31 engage slip holding surfaces 48 so that slip 40 does not fall out of recess 28. Slip holding surfaces 48 slide on recess holding surfaces 31 when moving from the unset to the set position.

As also illustrated in FIGS. 2-4, slip 40 includes slip loading surfaces 49, to facilitate slip 40 gripping fish 200 when overshot tool 10 is in its set position (FIGS. 4 and 8). Slip loading surfaces 49 are disposed on the sides of slip 40 and engage mating recess loading surfaces 32 of recess 28. As shown in FIGS. 4A and 4B, recess 28 has a smaller circumferential width at its base 29 than at bore wall surface 26. Recess loading surfaces 32 are in planes that diverge from each other at positive included angle 50 (FIG. 4A) in an inward direction toward housing outer diameter axis 25.

Slip loading surfaces 49 are at the same angles and slidingly engage recess loading surfaces 32 both in the unset position and the set position. Slip loading surfaces 49 and recess loading surfaces 32 are able to stay in engagement with each other between unset and set positions because the cross-sectional width of recess 28 decreases in a downward direction, as indicated by FIGS. 4A and 4B. As slip 40 moves downward, the decreasing width of recess 28 cams slip 40 radially inward toward axis 25. The angles of slip loading surfaces 49 and recess loading surfaces 32 cause slip loading surfaces 49 to provide circumferential loading on housing 12. Referring to FIG. 4A, recess loading surfaces 32 provide a reacting force F against slip loading surfaces 49 of slips 40. Force F is normal to the recess loading surfaces 32 and slip loading surfaces 49 and has a radial component Fr and a circumferential component Fc. Decreasing the included angle 50 between recess loading surfaces 32 and slip loading surfaces 49 increases the circumferential force component Fc and decreases the radial force component Fr. However, decreasing the included angle 50 decreases the size of the recess loading surfaces 32 and slip loading surfaces 49. Included angle 50 must be positive or greater than zero degrees, which would exist if the two recess loading surfaces 32 were parallel to each other. While in the set position, slip loading surfaces 49 engage recess holding surfaces 32 so that slip 40 can grip and secure fish 200 within housing bore 18. Although slip outer wall surface 39 may contact recess base 29 while in the unset position, it is spaced from recess base 29 while in the set position, as shown in FIGS. 4A-4C.

As will be recognized by persons of ordinary skill in the art, slip 40 is capable of limited axial movement within recess 28 when overshot tool 10 is in its unset position. In other words, slip 40 is not completely reciprocal with recess 28 such that slip 40 fits snuggly within recess 28. Gaps 34 shown in FIG. 4 illustrate this point. The ability of slight movement by slip 40 within recess 28 permits slip 40 to easily slide over and around fish 200 until overshot tool 10 is moved to the set position as described in greater detail below.

The length and width, and, thus, the shape of recess 28, as well as the length, width, and the shape of each corresponding slip 40 held within recess 28 can be easily modified to facilitate gripping of numerous types of fish 200. In a preferred embodiment best illustrated in FIG. 4, recess 28 and slip 40 have a multi-tiered arrowhead shape design, a narrow width relative to the length. As previously mentioned, in each section, the width between recess loading surfaces 32 and the width between slip loading surfaces 49 taper from a larger width to a smaller width in a downward direction as can be seen by comparing FIGS. 4A and 4B. In the example of FIG. 4, there are three separate sections of recess 28 and slip 40 that taper in width. Each section has the same maximum width and the same minimum width in this example. The narrow width relative to the length provides circumferential loading of housing 12 by slip 40. Preferably, the width of slip 40 and, thus, recess 28 are such that slips provide little radial loading on housing 12. As discussed above, some of the loading on housing 12 by slip 40 is circumferential loading.

Additionally, as best shown in FIGS. 2 and 4, gripping wall surface 43 may include multiple varying gripping profiles to facilitate gripping different types of fish 200. For example, gripping wall surface 43 may include first gripping profile 44, second gripping profile 45, and third gripping profile 46 all of which are different in design and shape as compared to each other. For example, the spacing between the grooves or wickers 47 may vary, and the depth of the wickers may vary from one section to the other.

Referring to FIG. 5, the gripping wall surface 43 on the portion of slip 40 contained in lower bore portion 22 are offset farther from housing axis 25 than the gripping wall surface 43 in upper bore portion 20. The reason for the difference is that in this embodiment, lower bore portion 22 has a larger diameter than upper bore portion 20.

In one specific embodiment shown in FIGS. 3 and 8, inner wall surface 26 of housing 12 has channel 59 to facilitate connection of actuation tool 60 (FIG. 8) to first end 41 of slip 40. Actuation tool 60 may be any tool known to persons of ordinary skill in the art capable of connecting to slip 40 and provide movement of slip 40 axially to facilitate slip 40 engaging and securing fish 200. In one specific embodiment shown in FIG. 8, housing bore 18 includes a third portion 61 disposed above upper portion 20. In the embodiment shown in FIG. 8, third portion 61 is eccentric with the outer diameter of housing 12 and housing axis 25. Thus, like upper portion 20 or lower portion 22, third portion 61 of housing bore 18 has an axis that does not coincide with housing axis 25. In other words, third portion 61 has an axis that is offset from and parallel to housing axis 25. Although third portion 61 of housing bore 18 is shown as being eccentric in relation to housing axis 25, it is to be understood that third portion may be concentric with housing axis 25; all three portions of housing bore 18, i.e. upper portion 20, lower portion 22, and third portion 61, all may be concentric with housing axis 25; only one of the three portions 20, 61, 22 may be concentric with housing axis 25; or any two of the three portions 20, 61, 22 may be concentric with housing axis 25. Moreover, one or more of the three portions 20, 61, 22 may share a common axis or all three portions 20, 61, 22 may have different axes.

In operation, upper end 13 of overshot fishing tool 10 is connected, such as by threads, to a string (not shown). Overshot tool 10 is then lowered into the wellbore, i.e., run into the wellbore, in the direction of arrow 52 using equipment and methods known in the art. Overshot tool 10 is disposed over fish 200 such that fish 200 enters housing bore 18 through opening 15. As overshot tool 10 is being placed over fish 200, slips 40 remain within recesses 28 as illustrated in FIG. 5. Overshot tool 10 is disposed over fish 200 sufficiently so that fish 200 can be secured within housing bore 18. Preferably, fish 200 is disposed with both upper portion 20 and lower portion 22 of housing bore 18 as shown in FIG. 8.

After fish 200 is sufficiently disposed within housing bore 18, slips 40 are moved to the set position shown in FIGS. 4 and 8 by one of the methods described below to engage fish 200. Also, overshot tool 10 may be moved or stroked axially, such as in the direction of arrow 51, relative to fish 200 to engage gripping wall surface 43 with fish 200, as illustrated in FIG. 8, causing fish 200 to be secured within housing bore 18. Slips 43 will not begin to grip fish 20 until they are moved axially relative to housing 12. In FIG. 8, the upper portion of slips 40 is shown gripping fish 20, but because of the larger diameter in lower bore portion 22, the lower portion of slips 40 is not gripping fish 20.

Upon actuation of slips 40, e.g., by axially movement of slips 40 relative to housing 12, slip holding surfaces 48 of slip 40 slide along recess holding surfaces 31 increasing the length of gaps 34 as shown in FIG. 4. As a result, slip 40 moves until becoming locked within recess 28 by fish 200. Fish 200 will also be engaged by the smooth bore portion of housing bore 18 opposite slips 40. Once secured, overshot tool 10 and fish 200 can be raised out of the wellbore.

Various devices could be employed as actuation tool 60 to cause relative axial movement between slips 40 overshot tool 10 and fish 200. For example, actuation tool 60 could comprise a piston slidably mounted at the upper end of tool 10. The operator would pump fluid through the string, which causes the piston to move downward, pushing slips 40 downward from the unset to the set position. As shown in FIG. 8, actuation tool 60 is connected to first end 41 such as by having T-shaped extension 41' being placed within a slot (not shown) of a flange (not shown) or other platform of actuation tool 60 so that the top portion of T-shaped extension 41' rests on the flange or platform. While connected, slip 40 may be permitted to move slightly. In other words, slip 40 is not rigidly secured to actuation tool 60. Therefore, slip 40 "hangs" from actuation tool 60.

To set overshot tool 10 after fish 200 is disposed within housing bore 18, actuation tool 60 is moved axially in the direction of arrows 51 and 52 until fish 200 is secured within housing bore 18. As will be recognized by persons skilled in the art, a single movement of actuation tool 60 in the direction of arrow 51 may sufficiently secure fish 200. Alternatively, repeated axially movement of actuation tool 60 in the directions of arrows 51, 52 may be necessary to move fish 200 upwards or within housing bore 18 sufficiently to secure fish 200 within housing bore 18. As those skilled in the art will recognize, different types of fish will require different amounts of axially movement of housing 12 to secure fish 200 within housing bore 18.

Alternatively, tool 10 could be set other than by hydraulic pressure pumped down the conduit or drill string. A double hydraulic piston (not shown) could be employed that will stand off on the fish. The piston standing off the fish will stroke opposite the setting piston. The slips are attached to the setting piston by means of a linkage. They can be secured in place for travel down the wellbore by a shear mechanism or rupture disc. During the setting process, the slips are stroked out and the fish is trapped between the slips and the tool body. Once the slips are stroked out to engage the fish, they become self engaging when the fish is pulled on in tension.

It is to be understood that the invention is not limited to the exact details of construction, operation, exact materials, or embodiments shown and described, as modifications and equivalents will be apparent to one skilled in the art. Additionally, the tool could be designed with a single concentric bore. Alternatively, housing bore 18 may include a flange or platform formed within housing bore, the flange or platform having a slot for receiving the T-shaped extension first end of the slip, thus permitting the slip to hang within the housing bore. In this embodiment, the overshot tool may be set by axial movement of the housing without the need for any additional equipment. Moreover, in one embodiment, a single slip within a single recess may be utilized. Alternatively, multiple slips, having multiple shapes and gripping profiles may be utilized with substantially reciprocal recesses. Moreover, the housing may have a shape other than cylindrical. Additionally, the housing bore may be elliptically-shaped or have another non-circular shape desired or necessary to facilitate gripping the fish. Accordingly, the invention is therefore to be limited only by the scope of the appended claims.

What is claimed is:

1. An overshot tool for retrieving an object in a well, the tool comprising:

a housing having an upper end for attaching to a string for lowering the tool into a well, a housing bore defined by an inner wall surface, the inner wall surface having a recess disposed therein; and a slip carried within the recess, the slip having an upper slip end, a length, a width, and a gripping wall surface facing toward the housing bore, the gripping wall surface having a gripping profile to engage and facilitate securing an object within the housing bore, and the slip being movable relative to the recess from an unset position to a set position wherein the gripping wall surface protrudes into the bore, a lower portion of the housing being open at a lower end of the housing for sliding over the object in the well while the slip is held in the recess, so that subsequent actuation of the slip toward the set position causes the gripping profile of the gripping wall surface to engage and secure the object for retrieval, and the slip and the recess having mating loading surfaces that provide a circumferential force component in the set position, wherein the housing has a sidewall with a thicker portion and a thinner portion opposite the thicker portion, and wherein the recess and the slip are located in the thicker portion opposite from a smooth portion of the housing bore.

2. The overshot tool of claim 1, wherein the gripping wall surface of the slip is substantially flush with the inner wall surface of the bore while in the unset position.

3. The overshot tool of claim 1, wherein the slip is actuatable by axial movement of the slip relative to a longitudinal axis of the housing.

4. The overshot tool of claim 1, wherein the gripping wall surface comprises at least two gripping profiles, wherein at least two of the at least two gripping profiles are different.

5. The overshot tool of claim 1, wherein the housing bore has an upper portion with a diameter smaller than a lower portion of the bore, and the recess and the slip each comprise a length that transverses the upper portion and the lower portion of the housing bore.

6. The overshot tool of claim 1, wherein the recess and the slip have widths that taper along their lengths.

7. The overshot tool of claim 1, wherein:

the recess has a base, loading surfaces, and a width between the loading surfaces, the loading surfaces being located in planes that diverge in an inward direction and the width of the recess between the loading surfaces gradually decreases along the length of the recess;

the slip has loading surfaces and a width between the loading surfaces, the loading surfaces being at the same angles and mate with the loading surfaces of the recess; and the width of the slip decreases along its length the same as the recess, so that moving the slip along the length of the recess in one direction causes the gripping surface of the slip to protrude from the recess.

8. The overshot tool of claim 1, wherein the upper slip end comprises an attachment member to facilitate actuation of the slip by axial movement of the slip relative to the housing.

9. The overshot tool of claim 1, wherein the housing comprises a plurality of the recesses, each carrying one of the slips therein.

10. The overshot tool of claim 1, wherein the slip has a multi-tier arrowhead shape of varying width along its length.

11. The overshot fishing tool of claim 1, wherein the gripping profile comprises a plurality of wickers.

12. An overshot tool for retrieving an object in a well, the tool comprising:

a housing having a string connection end, an open end, and a housing bore with an axis disposed longitudinally through the housing and in fluid communication with the open end;

at least one elongated recess in the bore, the recess having a base and two loading surfaces that diverge relative to each other, the recess having a width between the loading surfaces that decreases in an axial direction;

a slip disposed within each of the at least one recesses, the slip having a length and loading surfaces that mate with the loading surfaces of the recess, the slip having a width between its loading surfaces that decreases in the same manner as the recess, and the slip having a gripping wall surface facing toward the housing bore; and an actuator for moving the slip axially relative to the recess, which causes the gripping wall surface to move inward into the bore to grip an object in the well.

13. The overshot tool of claim 12, wherein the loading surfaces of the recess are located in planes that have a positive included angle between them.

14. The overshot tool of claim 12, further comprising:

an undercut portion along part of each of the loading surfaces of the recess, defining a slip retaining shoulder; and a shoulder on each loading surface of the slip that fits within the undercut portion behind the slip retaining shoulder.

15. The overshot tool of claim 12, wherein the slip and the recess each comprise a multi-tier arrowhead shape, each tier of the multi-tier arrowhead shape having a width that decreases from a maximum to a minimum.

16. A method of retrieving a fish disposed in a bore of a well, the method comprising the steps of:

(a) running an overshot tool into a well, the overshot tool comprising a housing having a longitudinal housing bore defined by an inner wall surface, the inner wall surface having a recess disposed therein and a slip carried within the recess, the slip having a length, a width, and a gripping wall surface facing toward the housing bore, the width being narrower than the length, wherein the slip and the recess are located opposite a smooth portion of the inner wall surface of the housing bore;

(b) lowering the housing bore over the fish while the slip is held within the recess;

(c) moving the slip longitudinally relative to the recess to protrude into the bore and engage the gripping wall surface with the fish through a circumferential force component to secure the fish within the housing bore; then (d) removing the overshot tool and the fish from the bore of the well.

17. The method of claim 16, wherein step (c) is performed by applying fluid pressure to a piston.

18. The method of claim 16, wherein:

step (a) is performed by lowering the tool on a string of conduit; and step (c) is performed by pumping fluid down the conduit to a piston located in the housing bore.

19. An overshot tool for retrieving an object in a well, the tool comprising:

a housing having an upper end for attaching to a string for lowering the tool into a well, a housing bore defined by an inner wall surface, the inner wall surface having a recess disposed therein; and a slip carried within the recess, the slip having an upper slip end, a length, a width, and a gripping wall surface facing toward the housing bore, the gripping wall surface having a gripping profile to engage and facilitate securing an object within the housing bore, and the slip being movable relative to the recess from an unset position to a set position wherein the gripping wall surface protrudes into the bore, a lower portion of the housing being open at a lower end of the housing for sliding over the object in the well while the slip is held in the recess, so that subsequent actuation of the slip toward the set position causes the gripping profile of the gripping wall surface to engage and secure the object for retrieval, and the slip and the recess having mating loading surfaces that provide a circumferential force component in the set position, wherein the housing bore has an upper portion with a diameter smaller than a lower portion of the bore, and the recess and the slip each comprise a length that transverses the upper portion and the lower portion of the housing bore.

20. An overshot tool for retrieving an object in a well, the tool comprising:

a housing having an upper end for attaching to a string for lowering the tool into a well, a housing bore defined by an inner wall surface, the inner wall surface having a recess disposed therein; and a slip carried within the recess, the slip having an upper slip end, a length, a width, and a gripping wall surface facing toward the housing bore, the gripping wall surface having a gripping profile to engage and facilitate securing an object within the housing bore, and the slip being movable relative to the recess from an unset position to a set position wherein the gripping wall surface protrudes into the bore, a lower portion of the housing being open at a lower end of the housing for sliding over the object in the well while the slip is held in the recess, so that subsequent actuation of the slip toward the set position causes the gripping profile of the gripping wall surface to engage and secure the object for retrieval, and the slip and the recess having mating loading surfaces that provide a circumferential force component in the set position, wherein the recess comprises a base, loading surfaces, and a width between the loading surfaces, the loading surfaces being located in planes that diverge in an inward direction and the width of the recess between the loading surfaces gradually decreases along the length of the recess, the slip comprises loading surfaces and a width between the loading surfaces, the loading surfaces being at the same angles and mate with the loading surfaces of the recess, and the width of the slip decreases along its length the same as the recess, so that moving the slip along the length of the recess in one direction causes the gripping surface of the slip to protrude from the recess.

* * * * *